United States Patent [19]

Petrovich

[11] 4,220,525

[45] Sep. 2, 1980

[54] BENEFICIATION OF METALLIC ORES BY FROTH FLOTATION USING POLYHYDROXY AMINE DEPRESSANTS

[76] Inventor: Vojislav Petrovich, 1935 W. Schiller St., Chicago, Ill. 60622

[21] Appl. No.: 974,030

[22] Filed: Dec. 28, 1978

[51] Int. Cl.[2] ..... B03D 1/06

[52] U.S. Cl. ..... 209/167

[58] Field of Search ..... 209/5, 166; 210/54 R, 210/54 C; 252/61

[56] References Cited

U.S. PATENT DOCUMENTS

| | | | |
|---|---|---|---|
| 2,014,406 | 9/1935 | Weed | 209/166 |
| 2,177,985 | 10/1939 | Harris | 209/166 |
| 2,259,420 | 10/1941 | Mills | 209/166 |
| 2,338,797 | 1/1944 | Borglin | 209/166 X |
| 2,389,763 | 11/1945 | Cahn | 252/61 X |
| 3,165,465 | 1/1965 | Ray | 209/5 X |
| 3,194,758 | 7/1965 | Lissant | 210/54 R |
| 3,453,207 | 7/1969 | Eck | 210/54 C X |
| 4,128,475 | 12/1978 | Wang | 209/166 |
| 4,139,455 | 2/1979 | Griffith | 209/167 |

FOREIGN PATENT DOCUMENTS

| | | | |
|---|---|---|---|
| 594133 | 3/1960 | Canada | 209/166 |
| 1068191 | 11/1959 | Fed. Rep. of Germany | 209/166 |
| 426710 | 2/1973 | U.S.S.R. | 209/166 |

*Primary Examiner*—Robert Halper

[57] ABSTRACT

Beneficiation of metallic ores by froth flotation using polyhydroxy amines depressants for gangue material, such as silica, silicates, carbonates, sulfates, phosphates to obtain pure concentrates of desired metal values with adequate collectors; comprises, adding to a water suspension of finely divided ore of polyhydroxy amine to depress the said gangue material in the presence of an adequate collector for the recovering of the desired metal value.

1 Claim, No Drawings

BENEFICIATION OF METALLIC ORES BY FROTH FLOTATION USING POLYHYDROXY AMINE DEPRESSANTS

The present invention relates to flotation of minerals from their ores, and more particularly to the recovery of such metallic minerals which are inbedded in a matrix of silica, silicates, carbonates, sulfates, phosphates, etc.

The object of this invention is to provide an improved froth flotation procedure in which, through the application of polyhydroxy amines unwanted silicious gangue material and the like acidic gangue minerals are depressed by deactivating the same to the used collectors, and thereby largely eliminating said unwanted guangue material from the concentrate of desired minerals, thus improving the grade of the concentrate to a marked degree. It is also an object of this invention to provide an improved flotation procedure in which, through the application of said polyhydroxy amines a selective separation can be made between two or more valuable minerals by the application different promoters and collectors persevering at the same time the silica, the silicates, the carbonates, the phosphates and the like gangue material dispersed and depressed.

Froth flotation is roughly based on the fact that the surface of a given mineral to be recovered can be rendered, by the action of so-called collectors, more or less water repellent, i.e., aerophil, and a mineral-air complex, the specific gravity of which is lower than that of the pulp of mineral slurry, is thus formed with the air bubbles introduced into the pulp of mineral slurry. The binding of the collector to the mineral surface by forces of chemiadsorption, physicaladsorption, etc., is due to electrostatic forces in both of the collector itself and the said surfaces.

It is the custom to speak about "differential" flotation, only in the case of polymetallic concentration, but most of the usual monometallic flotations are also differential ones, as the gangue has to be prevented from floating together with the wanted mineral. If the used collector has a tendency to be adsorbed by the gangue (which is particularly the case of paraffinic oils, fatty acids, fatty alcohols, sulfated and sulfonated alkyl compounds, as well as the single amines etc., chiefly used in the flotation of metallic oxide ores and non-metallic ores), the latter must be "depressed". Roughly, depression consists in the action of preventing the binding of the collecting reagent to the surface of a certain mineral which is not wanted in the concentrate. In the case of monometallic flotation, the gangue minerals which are mostly quartz, silicates, and calcite, rarely sulfates and phosphates, must be depressed. In the case of polymetallic flotation, the gangue, together with other valuable metallic mineral, have to be kept from floating, or a single mineral has to be collected, while others are prevented from concentrating in the froth.

It is well known that alkyl amines used in froth flotation practice, many of them commercial products are silica and silicates collectors, because of which amine-flotation has developed as reverse froth flotation in which process the silica and the silicates are floated out as concentrates, while the desired metallic mineral is obtained in tailing, i.e., the procedure is a reverse concentration. Thus, the objective of the present invention is to introduce in the flotation circuit polyhydroxy amines, thus accomplishing a highly hydrophilic surface of silica, the silicates, carbonates, sulfates, phosphates, and the like acidic minerals in which a metal responsive to collector and flotation is bound to an acid radical, which hydrophilicity prevents silica, the silicates, the carbonates, the sulfates, the phosphates and the like minerals to float in the froth, and thus provoke a true froth flotation of desired metallic oxide mineral, leaving said minerals in tailing, which is quite different of the actual amine-flotation.

Although the usual gangue minerals when pure and fresh from the mine, are naturally more hydrophilic than the valuable metal-bearing ones, they are easily floated after activation with metallic cations. Thus quartz and most other silicates may be activated by very small amounts of iron, copper, zinc, lead, nickel, titanium, barium and some other cations when floated with fatty acid or fatty alcohol collectors at pH values varying with each activating cation. Since in almost every pulp of mineral slurry there are soluble metallic salts, the gangue is always more or less activated and tends to concentrate in the flotation froth. This is particularly true when anion active high molecular aliphatic acids and alcohols or their derivatives are used as collectors. In order to keep the gangue from floating, it is usual to add alkalies such as sodium carbonate, sodium hydroxide and the like, or sodium silicate, or acids. Alkalies form easily wettable hydroxides with the activating cations and increase the hydrophilic character of quartz and the silicates by their tendency to form soluble alkali-silicates. Sodium silicate forms insoluble metallic-silicates and hydrated metallic silica-gels with the activating cations. The acidification of the pulp of mineral slurry tends to replace the adsorbed metallic cations by more positive hydrogen ions which are hydrophilic, and increases the solubility of certain minerals. In addition to the effect of the alkalies, the use of alkali cyanide for the depression of the gangue is used frequently. Cyanide forms soluble complexes with some activating heavy metal cations removing them by means of this reaction from the gangue surface. The addition of cyanide to a pulp of mineral slurry of a number of metallic oxide ores may be highly deleterious because of formation of highly wettable ferri or ferro metal complex cyanides, thus highly diminuting the recovery.

It is therefore obvious, that in the flotation of ores chemical and physical control is directed firstly, toward increasing the floatability of the wanted minerals and, secondly, toward minimizing any flotation tendecy exhibited by the unwanted gangue minerals contained in the admixture.

The present invention has the second of these objectives in view and, for the accomplishment of the same, it proposes to add to the flotation pulp of mineral slurry relatively small amounts of certain polyhydroxy amines, which will be described presently, that react with the silicic acid of the silica and the silicates of the gangue minerals, thus preventing the flotation of unwanted gangue minerals of the oxide ore matrix.

Broadly, the invention embraces the addition to a flotation pulp of mineral slurry of amine compounds able to form very stable, water insoluble but hydrophilic compounds with silica, i.e., silicic acid, which being adsorbed on the gangue particles prevent or inhibit the same particles from exerting an activating, i.e., promoting effect, thus inhibited from concentrating in the flotation froth.

Generally speaking, therefore the flotation of non-sulfide ores, i.e., the metallic oxide ore has been performed with collectors which are mainly unsaturated fatty acids, unsaturated higher aliphatic alcohols, unsaturated hydrocarbons, or derivatives thereof. These collectors unlike for example, the xanthates used in the flotation of sulfides, are not very specific, they have marked tendency to float the ferromagnesian silicates, as well as a gamut of calcium, iron, aluminum, magnesium etc. compounds by forming insoluble soaps. As the aim of froth flotation is selective separation between the valuable mineral and the gangue, the latter has to be depressed.

As stated above, silica, the silicates, the carbonates, the sulfates, the phosphates will adsorb polyhydroxy amines of this invention rendering them harmless to the froth flotation of desired metallic mineral. More specifically the polyhydroxy amines will tie up the above said acid radicals bound to a certain metal in a certain mineral, eliminating thus all such minerals as active factors in the process, i.e., the gangue minerals; the quartz, the silicates, the carbonates, the sulfates, the phosphates will therefore exhibit no tendency to contaminate the concentrates.

In the field of selective flotation, the present invention makes feasible the specific depression of one or several silicate minerals by the addition of an adequate amount of polyhydroxy amines, of various strength and alkalinity, as desired and needed, for reacting with silicic acid bound in the silicate mineral so as to prevent flotation by rendering said silicate surface hydrophilic or water-avid.

This invention is based upon the principle that metallic minerals in which the metal is bound to an acid, the acid radical may be caused to form much more stable undissociable, water soluble or insoluble, but hydrophilic compounds with polyhydroxy amines of various basicity, which will be set forth hereinafter, which are added to the pulp of mineral slurry to depress the gangue minerals.

The polyhydroxy amine depressant, which are the specific subject of this invention have the following structural characteristics:

| | | |
|---|---|---|
| | AMINOBUTANE-TRIOLS | $HOCH_2(CHOH)_2CH_2NH_2$ |
| such as | Amino-tert.-butylglycerol | $(HOCH_2)_3C—NH_2$ |
| | Tris-(hydroxymethyl)-aminomethane | " |
| | AMINOPARTITOLS | AMINO-TETROLS |
| such as | Xylamine | $HOCH_2(CHOH)_3CH_2NH_2$ |
| | AMINOHEXITOLS | AMINO-PENTITOLS |
| such as | Glucamine | $HOCH_2(CHOH)_4CH_2NH_2$ |
| | Mannamine | " |
| | Dulcitamine | " |
| | Fructamine | " |
| | AMINOHEPTITOLS | AMINO-HEXITOLS |
| such as | Perseitolamine | $HOCH_2(CHOH)_5CH_2NH_2$ |
| | Mannoheptitolamine | " |
| | Glucoheptitolamine | " |
| | AMINOOCTITOLS | AMINO-HEPTITOLS |
| such as | Glucooctitolamine | $HOCH_2(CHOH)_6CH_2NH_2$ |
| | Mannooctitolamine | " |
| | PENTOSE-AMINES | |
| such as | Arabinosamine | $HOCH_2(CHOH)_2CH(NH_2)CHO$ |
| | Xylosamine | $HOCH_2(CHOH)_2CH(NH_2)CHO$ |
| | HEXOSE-AMINES | |
| such as | Glucosamine, Chitosamine | $HOCH_2(CHOH)_3CH(NH_2)CHO$ |
| | Fructosamine | $HOCH_2(CHOH)_2CH(NH_2)CHO$ |

The Examples of investigating the polyhydroxy amines are accomplished with fatty acids such as Acyntol, i.e., tall oil from Arizona Chemical Co., Oleic, Linoleic, and Linolenic acids from Emery Chemical Co., because earth alkaline silicates are responsive to fatty acids. Various natural ores and compositions of minerals, as well as pure silica sand are examined by said polyhydroxy amines in conjunction with said fatty acids. The commercial amines such as ARMEN, DUOMEN, ARMAC, DUOMAC, from the ARMAK Company, which are applied as froth flotation reagents in reverse flotation to float silica and the silicates of various ores are investigated parallel, but here reported only for pure silica sand, pure serpentine, pure calcite, pure barytes, pure apatite, in the amount of 400 g of each as increment in the froth flotation process.

Natural chromite in serpentine has given excellent chromite concentrate in which only very very few grains of transparent yellowish and greenish serpentine were observed under the microscope.

Table 1

| Example ore treated | | Collector used gr per ton of ore | | Recovery by weight percent concentrate | tailing |
|---|---|---|---|---|---|
| 1. | Silica sand | Duomeen | 0.05 kg/t | 95.0 | 5.0 |
| 2. | Silica sand | Duomac | 0.05 kg/t | 96.0 | 4.0 |
| 3. | Serpentine | Armeen | 0.05 kg/t | 92.0 | 8.0 |
| 4. | Serpentine | Armac | 0.05 kg/t | 94.0 | 6.0 |
| 5. | Calcite | Duomeen | 0.05 kg/t | 92.0 | 8.0 |
| 6. | Barytes | Duomac | 0.05 kg/t | 90.0 | 10.0 |
| 7. | Apatite | Armeen | 0.05 kg/t | 90.0 | 10.0 |

Table 2

| Example ore treated | | Collector kg/t | kg/t | Depressor kg/t | Recovery weight % concentrate | tailing |
|---|---|---|---|---|---|---|
| 10. | Serpentine | Tall oil 1 kg/t | | Glucosamine 0.05 kg/t | Serpentine 2.0 | Serpentine 98.0 |
| 11. | Calcite | Oleic acid 1 kg/t | | Arabinamine 0.05 kg/t | Calcite 4.0 | Calcite 96.0 |
| 12. | Calcite | Oleic acid 1 kg/t | | Fructamine 0.05 kg/t | Calcite 5.0 | Calcite 95.0 |
| 13. | Barytes | Linolic acid 1 kg/t | | Fructosamine 0.05 kg/t | Barytes 3.5 | Barytes 96.5 |
| 14. | Apatite | Tall oil 1 kg/t | | Glucamine 0.05 kg/t | Apatite 4.0 | Apatite 96.0 |
| 15. | Silica sand | — | | Glucosamine 0.05 kg/t | Silica 2.0 | Silica 98.0 |

Table 1, shows that commercial amines are excellent collector-frothers for silica and the silicates, and the investigated acid minerals in which the metal is bound to an acid radical. The recoveries are estimated by weighing the products, being of pure material. The high percentage of tailings relates to a coarse material, which needs further grinding and sizing. All investigated commercial amines yield high recoveries not only because of high responsiveness of investigated minerals but also because of excellent carrying froth developed by said amines. In the tailing there was visible only the coarse material.

Table 2, shows that fatty acid collectors are ineffective collectors the gangues in the presence of polyhydroxy amines of this invention which act as depressants for serpentine, calcite, forytes, apatite silica sand. The floated serpentine is a slimy in froth occluded material only. In the case of calcite, barytes and apatite, fatty acids occlude only slimy material which is thoroughly oiled and therefore sticky. In the case of silica sand the depressing and inactivating of the silica sand was genuine. A true froth was not observed nor collected.

The comparison of the results shows that the ratio of depressed gangue is considerably lowered in float products by conditioning the pulp of mineral slurry with a polyhydroxy amine of this invention. Therefore, the use, according to the present invention, of polyhydroxy amines for accomplishing the purpose of gangue depression through the application of the same in froth flotation of various minerals of a variety of ores constitutes a marked advance in the art of froth flotation, and is highly advantageous in improving the selectivity of the used collectors, thus improving the grade of concentrate.

What is claimed is:

1. In concentration by froth flotation of metallic ores mixed with gangue minerals selected from the groups of silica, silicates, carbonates, sulfates, and phosphates, which includes the subjecting of such ore material when finely ground to froth flotation process; the step of adding to the mineral slurry an amount of the order of 0.05 kg per ton of ore treated with polyhydroxy amine wetting and depressing agents for silica, silicates, carbonates, sulfates, and phosphates; said polyhydroxy amines selected from the class containing one $NH_2$ group and from 3 to 7 hydroxyl groups having one or other of the following formulas:

1. $HOCH_2\ (CHOH)_n\ (H_2NH_2$
2. $HOCH_2\ (CHOH)_nCH\ (NH_2)\ CHO$ where n is an integer from 2 to 6, said polyhydroxy amines being adapted to react with the gangue material of the mineral slurry, depress the gangue material inhibiting it to float in the froth, while the metallic minerals nonresponsive to polyhydroxy amines may be floated and collected with adequate collectors.

* * * * *